US005704285A

United States Patent [19]

van Haag

[11] Patent Number: 5,704,285

[45] Date of Patent: Jan. 6, 1998

[54] CALENDER FOR THE TREATMENT OF A PAPER WEB

[75] Inventor: Rolf van Haag, Kerken, Germany

[73] Assignee: Voith Sulzer Finishing GmbH, Krefeld, Germany

[21] Appl. No.: 612,172

[22] Filed: Mar. 7, 1996

[30] Foreign Application Priority Data

Mar. 9, 1995 [DE] Germany ..... 195 08 352.0

[51] Int. Cl.[6] ..... B30B 3/04; D21G 1/00

[52] U.S. Cl. ..... 100/331; 100/163 R; 492/56

[58] Field of Search ..... 100/93 RP, 161, 100/162 R, 163 R, 163 A, 164–166, 162 B, 172, 173, 331; 492/7, 46, 50, 52, 56, 59

[56] References Cited

U.S. PATENT DOCUMENTS

| | | | |
|---|---|---|---|
| 2,300,994 | 11/1942 | Thiele et al. | 100/163 A |
| 3,270,664 | 9/1966 | Veneman et al. | 100/162 R |
| 3,841,963 | 10/1974 | Schlunke | 100/161 |
| 4,466,164 | 8/1984 | Tadokoro et al. | 492/52 |
| 4,653,395 | 3/1987 | Verkasalo | 100/93 RP |
| 4,738,197 | 4/1988 | Mälkiä | 100/93 RP |
| 5,237,915 | 8/1993 | Rounsley . | |

FOREIGN PATENT DOCUMENTS 295 04 034 6/1995 Germany .

OTHER PUBLICATIONS

Lauterbach, Thomas J., "Synthetic Composite in Supercalenders:update", Tappi Journal, vol. 76, No. 6, 1993, pp. 115–119.

Peel, John D., "Supercalendering and soft nip calendering compared", Tappi Journal, vol. 74, No. 10, 1991, pp. 179–186.

Rothfuss, U., "In-line-und Off-line-Satinage von holzhaltigen, Tiefdruckfähigen Naturpapieren", Wochenblatt für Papierfabrikation, Nov. 12, 1993, pp. 457–466.

Gamsjäger, N., "Elastische Kalanderwalzenbezüge auf Basis Faser-Kunststoff-Verbund", Das Papier, No. 6, 1994, pp. 334–348.

"Die neuen Superkalanderkonzepte", Voith Sulzer Papiertechnik, 1994, No. 05/94 d.

*Primary Examiner*—Stephen F. Gerrity
*Attorney, Agent, or Firm*—Darby & Darby

[57] ABSTRACT

A calender for the treatment of a paper web has at least one roller stack made of "hard" and "soft" rollers. The soft rollers have a covering made of a plastic whose recovery, after deformation, is such that the depth of the remaining deformation, after a faulty formation of up to 1 mm thick passes through the working nip is a maximum of 5 percent of the thickness of the faulty formation. In this way, paper characteristics that have previously been obtained using conventional 12-roller calender can be obtained with a lower number of rollers.

8 Claims, 2 Drawing Sheets

24
17
PAPER MACHINE
18
P
27a
H
2
27
1
25
10
19
23
11
3
28a
H
4
12
31
CONTROL DEVICE
5
22
16
6
29
13
7
H
14
20
8
WINDING DEVICE
26
15
28
9
H
30
21

CALENDER FOR THE TREATMENT OF A PAPER WEB

BACKGROUND OF THE INVENTION

1. Field of the Invention

The present invention relates to a calender for the treatment of a paper web having one roller stack that has "hard" rollers and "soft" rollers as well as working nips formed respectively between one hard roller and one soft roller, whereby first one side and then the other side of the web is in contact with a hard roller.

2. Discussion of the Related Art

Many calenders of this type are known, for example, from the 1994 brochure "Die neuen Superkalanderkonzepte" [The New Supercalender Concepts], which is published by Sulzer Papertec Company (identification number 05/94 d). These calenders are used for the final treatment of a paper web so that the web will obtain the desired degree of roughness or smoothness, gloss, thickness, bulk and the like. These calenders are installed separately from a paper machine. The soft or elastic rollers have an outer covering that is primarily made of a fibrous material. The heatable rollers have a surface temperature up to about 80° C. The average compressive stress in the working nips during normal operation is between 15 and 30 N/mm$^2$, while maximum values of approximately 40 N/mm$^2$ have also been applied in the lowest working nip. The rollers are arranged in a roller stack. A roller stack with 9 or 10 rollers is sufficient for paper that is to be simply finished, such as writing paper. A stack with 12 to 16 rollers is required for higher quality paper, such as paper suitable for photogravure printing, technical papers or compression papers. However, a large machine of this type is expensive and requires a great deal of space.

In addition, so-called compact calenders are known in which a heatable roller forms a nip with a deflection-controllable soft roller. Two compact calenders can be connected in series to treat both sides of a paper web. However, these calenders can only be used to manufacture paper that requires simple finishing, but not high quality papers, such as silicon based paper or paper for photogravure printing. Moreover, compact calenders require that a large amount of deformation energy, in the form of heat, be added to operate the calender. The heatable rollers, therefore, have a surface temperature ranging from 160° C. to 200° C. A large amount of heat energy is radiated that must then be exhausted using air conditioners. Because the roller diameter in a compact calender is larger (for sturdiness purposes) than the roller diameter in a supercalender, higher loads per unit of length must be applied to produce the required compressive stresses for the desired finishing result. Furthermore, replacement rollers for the soft rollers are expensive because they must also be deflection-controllable.

SUMMARY OF THE INVENTION

It is an object of the present invention to provide a calender of the type described above that is smaller and less expensive to manufacture and operate but that nonetheless also affords excellent finishing results.

This object is achieved in accordance with a preferred embodiment of the present invention by providing:

$a_1$) a roller stack having 6 to 8 rollers with a changeover nip formed between two soft rollers; or $a_2$) by providing two similar stacks with 4 or 5 rollers each; and b) the soft rollers have a covering made of a plastic wherein, after a faulty formation in the paper web (e.g., a fold or other imperfection) of up to 1 mm thick passes through the working nip, the depth of the remaining deformation in the covering, upon recovering, is no more than 5 percent of the thickness of the faulty formation.

The common fiber material coverings of the soft rollers are to a great extent susceptible to marking. Every faulty formation that passes through a working nip, for example a fold in the paper web, leaves behind a comparably deep remaining deformation in the covering that can result in incomplete paper treatment each time the roller rotates. However, those markings, which are eliminated at certain intervals by machining or grinding, do not represent a serious disadvantage since sufficient working nips are available to ensure satisfactory paper treatment. On the other hand, one portion of the working nips in supercalenders of the prior art contribute little or nothing to the production of the desired paper characteristics. With regard to those characteristics, a 12-roller calender can be replaced by an 8-roller calender or a 2×5 roller calender. To take advantage of such a reduction in the number of rollers, a plastic is preferably used as the material for the covering, which is extremely unsusceptible to marking. This produces a paper with the desired characteristics that does not have any noticeable marking defects. The unavailability of working nips that contributes to the desired paper characteristic can be compensated for by supplying a slight amount of additional energy. Due to the low number of rollers, a higher average load per unit of length in the working nips will result. A moderate amount of heat may be added by using heatable rollers. Since the roller stack is not as tall as the supercalenders of the prior art, lower structures are sufficient which significantly reduces installation costs.

It is particularly advantageous for the depth of the remaining deformation, due to a faulty formation thickness of 1 mm, to be smaller than 0.04 mm and to decrease disproportionately as the thickness of the faulty formation decreases. A material of this type has remaining deformations that are so infinitesimally small that they do not noticeably affect the quality of the paper to be treated.

It is also recommended for the covering to be designed for a compressive strength of over 42 N/mm$^2$. This takes into account the fact that in some cases, it is advisable to work with a somewhat higher compressive stress.

The covering is preferably made of fiber-reinforced epoxy resin. A plastic of this type, with the characteristics specified above, is commercially available, for example, under the brand name "TopTec 4" from the Scapa Kern Company, of Wimpassing, Austria.

It is also preferable for upper and/or lower rollers to be deflection-controllable. In this way, the compressive stress can be distributed evenly over the entire width of the rollers.

It is also preferable for at least one roller, disposed adjacent to a working nip, to be heatable to a surface temperature above 100° C. In some cases, a moderate temperature increase to slightly above 100° C. is helpful in obtaining the same results with an eight-roller calender or a double stack of 2×5 roller calenders as are obtained with a conventional 12-roller calender.

DETAILED DESCRIPTION OF THE INVENTION

Figure 1:
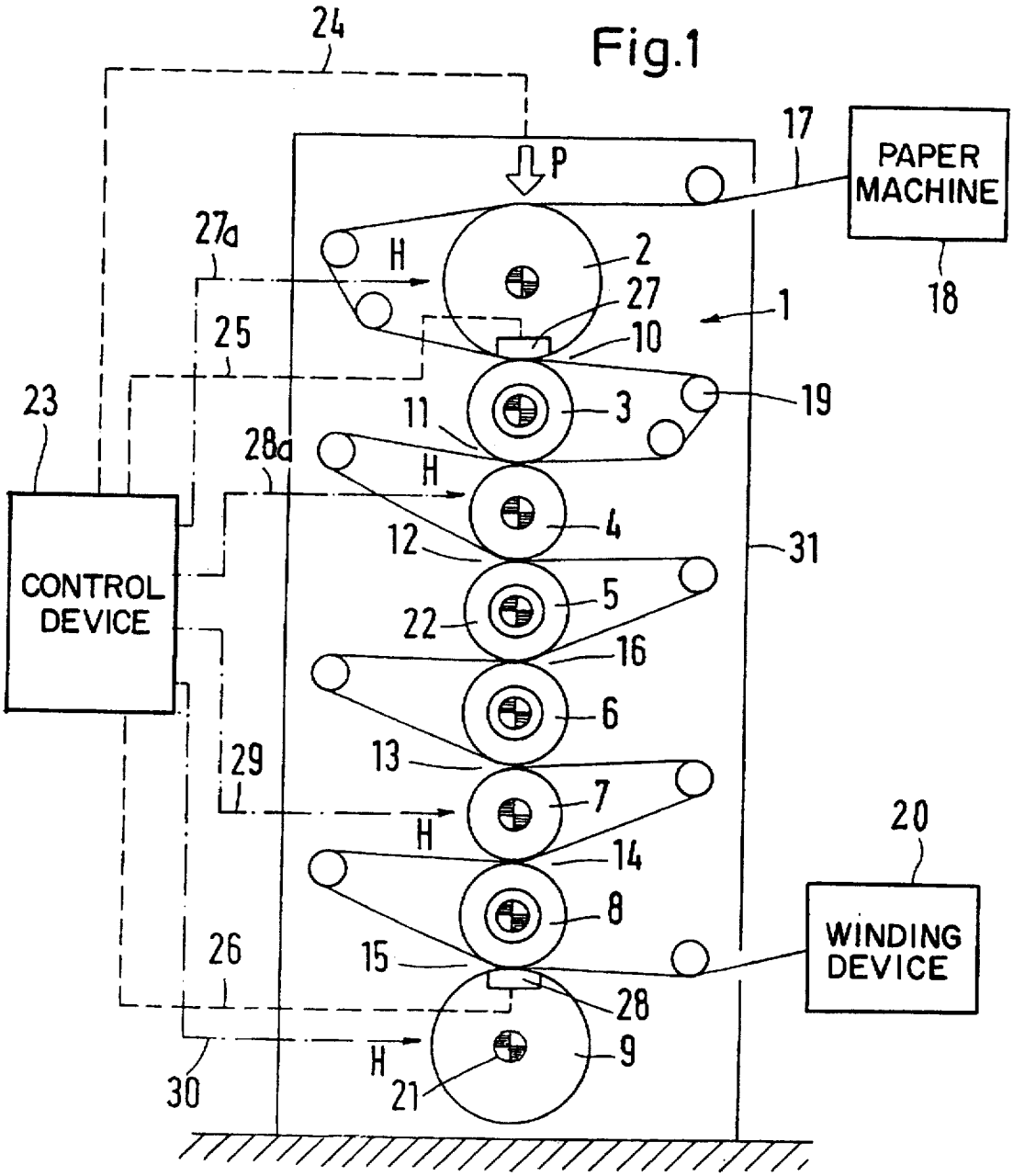
FIG. 1 is a schematic representation of a preferred calender in accordance with the present invention.

Referring now to FIG. 1, a calender 1 has one roller stack comprised of eight rollers, specifically, a heatable deflection-controllable hard upper roller 2, a soft roller 3, a heatable hard roller 4, a soft roller 5, a soft roller 6, a heatable hard roller 7, a soft roller 8, and a heatable, deflection-controllable hard lower roller 9. This configuration produces six working nips 10–15, each of which is delimited by one hard roller and one soft roller, and a changeover nip 16 which is delimited by two soft rollers 5 and 6.

A paper web 17 is fed out of a paper machine 18, web 17 passes, under the control of guide rollers 19, through the working nips 10–12, the changeover nip 16, and the working nips 13–15 after which it is wound onto a winding device 20. In the top three working nips 10–12, the paper web 17 has one of its sides contacting against the hard rollers 2, 4 and in the three lowest working nips 13–15, the paper web 17 has its other side contacting against the hard rollers 7, 9 so that the desired surface structure, such as smoothness or gloss, is produced on both sides of the paper web.

The direct connection between the calender 1 and the paper machine 18 results in an in-line operation. For this reason, each of rollers 2–9 has its own drive 21, thus allowing the paper web 17 to be pulled in during operation. Each of the soft rollers 3, 5, 6 and 8 has an outer covering 22 made of a plastic that is not susceptible to marking. In a preferred embodiment the outer covering 22 is made of a fiber-reinforced epoxy resin, which can be subjected to greater compressive stress, for example 45 N/mm$^2$ and higher. This material is also more resistant to higher temperatures than a covering made of fibrous material.

A control device 23 is connected to the calender 1 and has multiple functions as explained below:

The force P with which the upper roller 2 is pressed downward is controlled over a line 24. In a preferred embodiment, the lower roller 9 is held stationary. However, the load can also move in the opposite direction, so that force P acts on lower roller 9 and the upper roller 2 is held stationary. The load determines the compressive stress that is applied in the individual working nips 10–15. This compressive stress increases from the top to the bottom because the effective weight of the individual rollers is added to the loading force P. However, the increase in force in each stack according to the present invention is less than in supercalenders of the prior art, which have 12 rollers.

Devices 27 and 28 for deflection compensation of the upper roller 2 and the lower roller 9, respectively, are pressurized with pressure devices over lines 25 and 26. These devices ensure that there is an even compressive stress applied over the axial length of the roller. Any conventional deflection compensating devices can be used. However, it is preferred to use those devices in which support elements are arranged next to each other in a row, which elements can be pressurized individually or in zones at different pressures.

Rollers 2, 4, 7 and 9 are heatable as shown by arrows H. The heat energy that is added is controlled along dot-and-dash paths 27*a*, 28*a*, 29 and 30. The heating may be effected, for example, by electric heating, radiant heating or a heat exchange medium. A protective hood 31 provides heat insulation and ensures that the heat that is radiated as a result of the heating is only minimally exhausted into the surrounding environment.

The average compressive stress $\sigma$ applied in the lowest working nip 15, and preferably in all of the working nips 10–12 and 13–15, is between 45 and 60 N/mm$^2$ due to force P. The surface temperature of the heatable rollers 2, 4, 7 and 9 is preferably maintained between 100° and 150° C. due to heating H. The diameter of the rollers and the elasticity of the covering 22 are selected so that a nip width of about 2–15 mm, and preferably about 8 mm, is maintained. The dwell times t of the web 17 in each working nip 15 is about 0.1–0.9 ms. The dwell time is a function of the web speed. In a preferred embodiment, the temperature T is only slightly above the lower limit, for example 110° C., and the compressive stress is only slightly above the lower limit, for example 50 N/mm$^2$.

Figure 2:
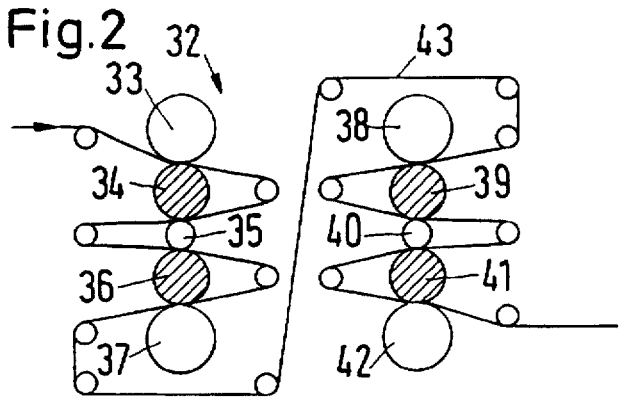
FIG. 2 is a schematic representation of an alternate embodiment of the present invention.

Referring to FIG. 2, a two roller stack calender 32, where each stack has five rollers, is illustrated. The first stack includes a hard upper roller 33, a soft roller 34, a hard roller 35, a soft roller 36, and a hard lower roller 37. The second stack includes a hard upper roller 38, a soft roller 39, a hard roller 40, a soft roller 41, and a hard lower roller 42. Each stack, therefore, has three working nips through which the paper web 43 passes such that in the first stack, one surface of the web 43 comes into contact with the hard rollers and in the second stack, the other surface of the web 43 comes into contact with the hard rollers. The heating of the rollers, the deflection control of the upper and lower rollers, and the loading of the two roller stacks can occur in a similar fashion to that of the calender in FIG. 1.

Figure 3:
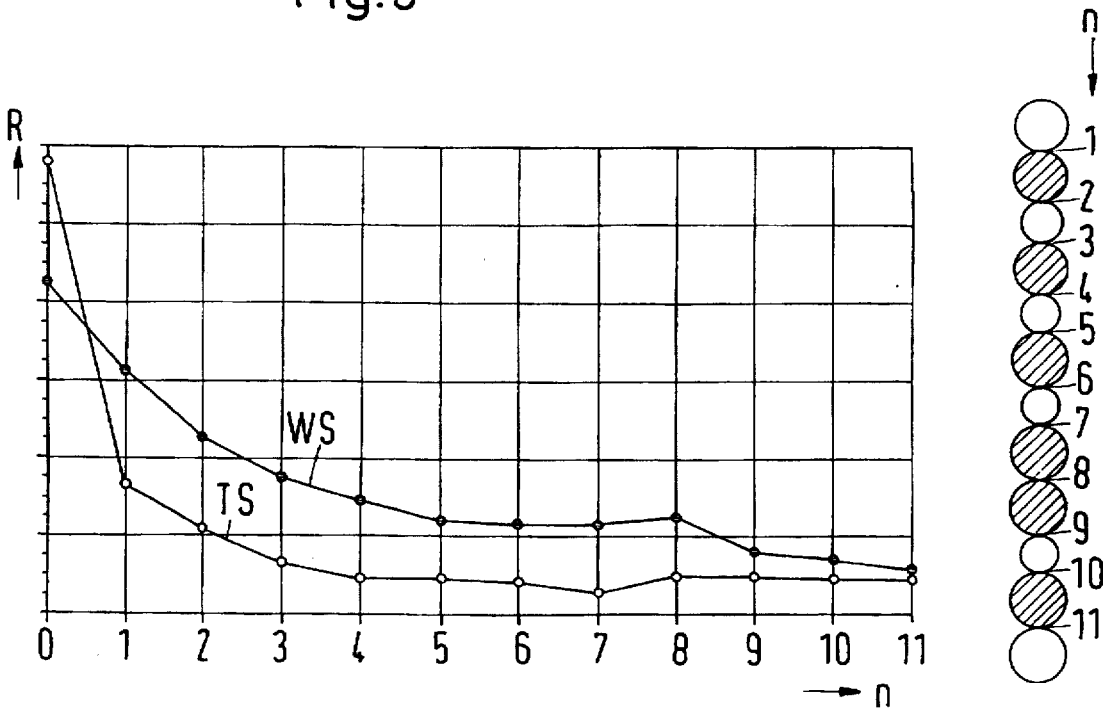
FIG. 3 is a diagram of the web's roughness over the number of working nips in a 12-roller calender.

Referring to FIG. 3, the roughness R of the web is shown as a function of the number n of nips that the web has passed through in a 12-roller calender. Curve "WS" refers to the "wireside" and curve "TS" refers to the "topside" of the paper web. The wireside is the side of the web which contacts the soft roller in the first working nip. The topside is the side of the web which contacts the hard roller in the first working nip. As can be seen in FIG. 3, in the "wireside" curve, only the first four nips and the last three nips are important to control the roughness of the web. Regarding the "topside" curve, only the first four nips are important to control the roughness of the web. Therefore, in accordance with the present invention, the treating of the paper web may be done with fewer rollers and with somewhat higher values for compressive stress and/or temperature. However, the present invention provides no additional nips to treat the paper web if it is damaged by markings on the soft rollers. Therefore, soft rollers are used that have a plastic covering, which covering is virtually unsusceptible to marking.

The results of tests are shown in the chart below in which small metal plates of varying thicknesses were fed through a working nip formed between one soft roller and one hard roller. One soft roller has an outer covering made of a fiber-reinforced epoxy resin that is not susceptible to marking, such as the one sold by Scapa Kern Company under the brand name "TopTec 4". The other soft roller has an outer covering made of a fibrous material, which cover is commonly used for supercalenders and which had the brand name "Fiberun Blue Denim".

| Thickness of metal plate | Depth of the remaining deformation | |
|---|---|---|
| | TopTec 4 | Fiberun BD |
| 0.1 mm | not visible | 0.02 mm |
| 0.5 mm | 0.01 mm | 0.21 mm |
| 1.0 mm | 0.03 mm | 0.45 mm |

The results of paper treatment can often be improved when the rollers, particularly the middle rollers, are held by levers (not shown), so that the overhanging weights are preferably compensated for by support devices, as is known from European reference EP 0 285 942 B1.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A calender for treating a paper web comprising:

at least one roller stack having a first end and a second end, said at least one roller stack being loaded on said first end, said at least one roller stack comprising:

at least two hard rollers having a substantially smooth outer surface;

at least two soft rollers, wherein each of said at least two soft rollers is disposed adjacent to at least one of said at least two hard rollers to form a working nip therebetween, whereby first one side and then the other side of the paper web is in contact with at least one of said at least two hard rollers;

the at least one roller stack comprises between six and eight hard and soft rollers with a changeover nip formed between two of said at least two soft rollers;

said at least two soft rollers have a covering made of a plastic whose recovery upon deformed by an object having a thickness of up to 1 mm results in a remaining deformation in the covering that is not more than 5 percent of the thickness of the object;

said covering covers at least one of said at least two soft rollers disposed adjacent to the working nip closest to said second end, and said covering is stable under a load corresponding to an average compressive stress over 45 N/mm$^2$; and at least one of said rollers adjacent to said working nip is heatable to a surface temperature between 100° C. and 150° C.

2. The calender of claim 1, wherein at least one of the rollers adjacent to the first end and the second end is deflection-controllable.

3. The calender of claim 1, wherein the depth of the remaining deformation in the covering, for an object that is 1 mm thick is smaller than 0.04 mm and said remaining deformation decreases disproportionately as the thickness of the object decreases.

4. The calender of claim 1, wherein said covering substantially comprises fiber-reinforced expoxy resin.

5. A calender for treating a paper web comprising:

at least one roller stack having a first end and a second end, said at least one roller stack being loaded on said first end and comprising:

at least two hard rollers having a substantially smooth outer surface;

at least two soft rollers, wherein each of said at least two soft rollers is disposed adjacent to at least one of said at least two hard rollers to form a working nip therebetween, whereby first one side and then the other side of the paper web is in contact with at least one of said at least two hard rollers;

the at least one roller stack comprises two similar stacks each comprising between four and five hard and soft rollers and each with a changeover nip formed between two of said at least two soft rollers;

said at least two soft rollers have a covering made of a plastic whose recovery upon being deformed by an object having a thickness of up to 1 mm results in a remaining deformation in the covering that is not more than 5 percent of the thickness of the object;

said covering covers at least one of said at least two soft rollers disposed adjacent to the working nip closest to said second end, and said covering is stable under a load corresponding to an average compressive stress over 45 N/mm$^2$; and at least one of said rollers adjacent to said working nip is heatable to a surface temperature between 100° C. and 150° C.

6. The calender of claim 5, wherein at least one of the rollers adjacent to the first end and the second end is deflection-controllable.

7. The calender of claim 5, wherein the depth of the remaining deformation in the covering for an object that is 1 mm thick is smaller than 0.04 mm and said remaining deformation decreases disproportionately as the thickness of the object decreases.

8. The calender of claim 5, wherein said covering substantially comprises fiber-reinforced epoxy resin.

* * * * *